United States Patent [19]

Goller et al.

[11] Patent Number: 4,807,451

[45] Date of Patent: Feb. 28, 1989

[54] KNITTED FABRIC WINDING-UP DEVICE FOR FLAT KNITTING MACHINES

[75] Inventors: Ernst Goller, Reutlingen; Fritz Walker, Kusterdingen, both of Fed. Rep. of Germany

[73] Assignee: H. Stoll GmbH & Co., Reutlingen, Fed. Rep. of Germany

[21] Appl. No.: 164,292

[22] Filed: Mar. 4, 1988

[30] Foreign Application Priority Data

Mar. 6, 1987 [DE] Fed. Rep. of Germany ..... 3707141

[51] Int. Cl.[4] ..... D04B 15/88

[52] U.S. Cl. ..... 66/149 R

[58] Field of Search ..... 66/149 R, 152, 151, 66/147, 150, 166

[56] References Cited

U.S. PATENT DOCUMENTS 4,027,506 6/1977 Bitzer ..... 66/149 R 4,121,440 10/1978 Humbert ..... 66/152

FOREIGN PATENT DOCUMENTS 237493 6/1987 European Pat. Off. ..... 66/152

47-39306 10/1972 Japan ..... 66/152

2117014 10/1983 United Kingdom ..... 66/152

*Primary Examiner*—Ronald Feldbaum

*Attorney, Agent, or Firm*—Larson and Taylor

[57] ABSTRACT

The knitted fabric winding-up device is formed as an auxiliary device which can be located beneath the needle beds (21, 22) on a lower supporting cross member (10), at the front side of a flat knitting machine, from which it is removable, and by means of a winding roller for formation of the fabric package (24) is pivotable from an inner position to an outer position. The winding roller (13) can, even in the outer position, be driven by a motor located in the lower supporting cross member (10) or can be decoupled and turned by hand.

13 Claims, 3 Drawing Sheets

KNITTED FABRIC WINDING-UP DEVICE FOR FLAT KNITTING MACHINES

DESCRIPTION

Figure 1:
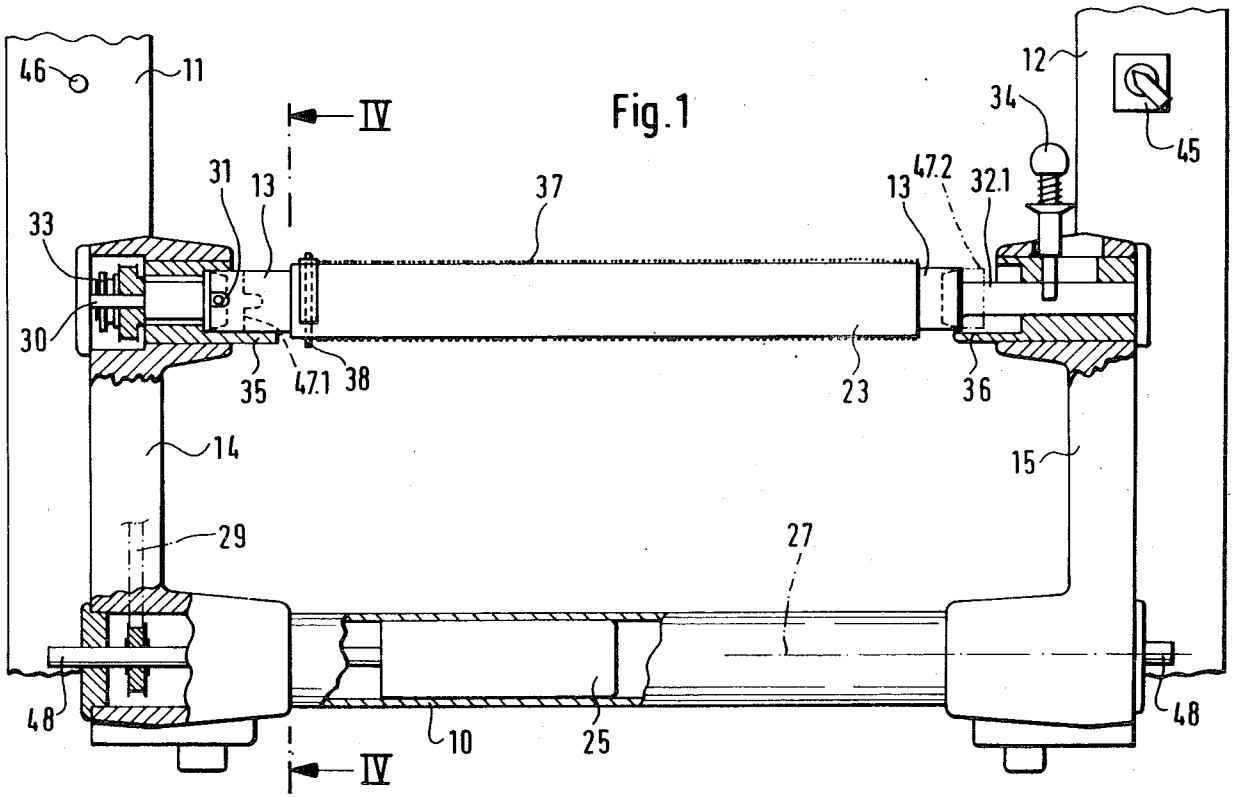

The invention relates to a knitted fabric winding-up device for flat knitting machines, with a winding roller which is interchangeably mounted on a support beneath the flat knitting machine, extends in the longitudinal direction of the machine, is driveable by means of a motor, and to which the knitted fabric is guided over a pivotable guide roller by whose weight the knitted fabric is tensioned and whose pivot range is limited in both directions by electrical switches of a control device, which acts on the drive motor of the winding-up device.

A winding-up device with the features set out above is known from DE-GM No. 74 10 448. It has the disadvantage that it is designed for a fixed mounting underneath the textile machine, for example a flat knitting machine, and it causes difficulty in the removal of the completed yarn package and in taking it out from beneath a flat knitting machine.

The problem which is the basis of the invention is to construct such a knitted fabric winding-up device so as to make it unnecessary to have it fixedly mounted on a flat knitting machine and so that it is also selectively mountable and it facilitates the removal of a completed yarn package.

The problem set forth is solved according to the invention in a knitted fabric winding-up device of the kind set out in the introduction in such a way that the support provided with the drive motor comprises a lower supporting cross member at both of whose ends upwardly directed supporting arms are located and are pivotable over a limited arc about an axis extending in the longitudinal direction of the supporting cross member, and at whose free upper ends the mounting positions and the coupling positions for the ends of the interchangeable winding roller are constructed, the arrangement being such that the winding roller is pivotable from an inner position to an outer positon located at the front side of the flat knitting machine, and is also pivotable in the reverse direction.

By means of the lower supporting cross member of the winding-up device, the opposed location of the mounting positions formed on the supporting arms for the winding roller is established and an independent arrangement of the winding-up device beneath the flat knitting machine is possible. The yarn package can be pivoted out from under the flat knitting machine by means of the pivotable supporting arms. Thereby, not only is the removal of the completed fabric package facilitated but also the fabric package can at any time be pivoted to a position which permits the free run-off of the knitted length or lengths of fabric into a conventional storage container, which can remain located along the lower supporting cross member.

The driving device for the winding-up device can advantageously be so located and constructed that it is operable independently of the pivot position and thus a machine drive of the winding roller can be effected, as desired, in any pivot position of the supporting arms. To this end, the drive motor for the winding-up device can, for example, be located on one of the pivoted arms. However, the drive motor for the winding-up device can advantageously be located in the base cross member and can act on a drive wheel arranged co-axially or concentrically with the pivot axis of the supporting arms and co-operating with a drive belt located in one of the supporting arms.

The winding roller of the driving device is interchangeable and can therefore be released from its mounting positions. To this end, the mounting positions and the coupling positions for the winding roller can be so formed in the supporting arms that the release of the winding roller ends is effected at one end at least by an axial movement out of its driven mounting and coupling position, whilst at the other end, suitably, the winding roller is mounted by means of a short concentric coupling shaft, which extends into the end of the roller and can be longitudinally shifted to effect the release. Because of this arrangement, both ends of the winding roller can be completely released from their mounting positions, so that the winding roller can be lowered with its two ends into reception dishes on the two pivotable supporting arms in front of and below the mounting positions and projecting above the supporting arms. These dishes not only have the advantage that they prevent the fabric package formed from falling to the ground on release of the winding roller, but they also permit the package to be easily turned by hand and at the same time under visual control, if, for example, a length of knitted fabric layed down in the usual way in layers in a container is subsequently, when the supporting arms are pivoted outwardly, to be wound up slowly by hand on a winding sleeve pushed onto the winding roller and suitably provided with an outer retention coating. This subsequent winding up can—as already mentioned—also be carried out mechanically, with the supporting arms pivoted out, for which purpose the drive motor can suitably be constructed with a slow speed gear and so that it can at any time be rotated in the opposite direction. The selection of the direction of rotation of the drive motor allows a choice of the surface of the knitting, which is to appear as the visible side on the fabric package.

A winding-up device constructed according to the invention does not therefore restrict a flat knitting machine, to which it is fitted, to a continuous wind-up of the knitted fabric produced. It can be constructed as an auxiliary device which can be easily separated from and selectively fitted to one flat knitting machine or another, for which purpose the support can suitably be constructed to be movable or so as to be mountable in a prepared mounting position on the frame of a flat knitting machine.

The device can also be installed without a drive motor for the winding roller and without associated switching mechanisms, so that the winding-up is effected by hand. The suitability of the device can be increased by provision of a stop switch for the associated control device, which is adjustable to various package diameters and can, if desired, be extended to synchronous pivoting of the two supporting arms by separate drive devices, which permit automatic outward pivotal movement of the winding roller when a predetermined package diameter has been reached, so that the following length of knitted fabric can descend without hindrance into a storage container.

There will be described below in greater detail with reference to the accompanying drawing an embodiment of a knitted fabric winding-up device constructed in accordance with the invention.

Figure 3:
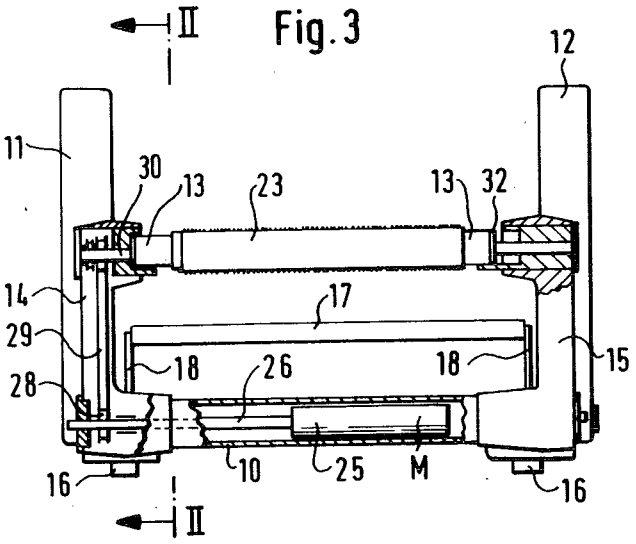
Figure 2:
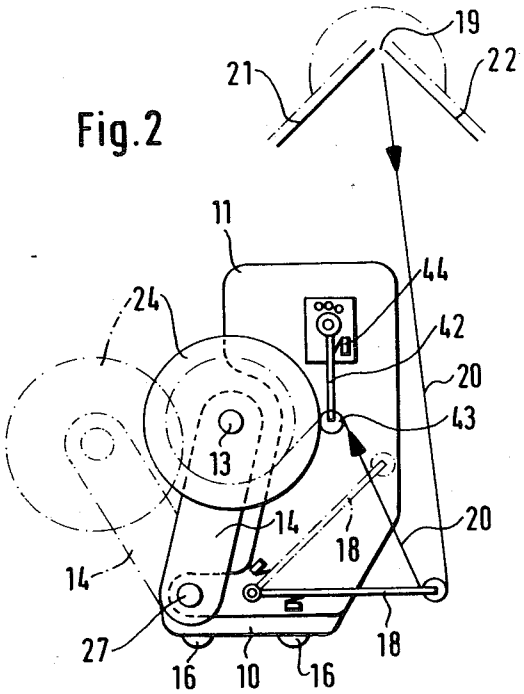
Figure 4:
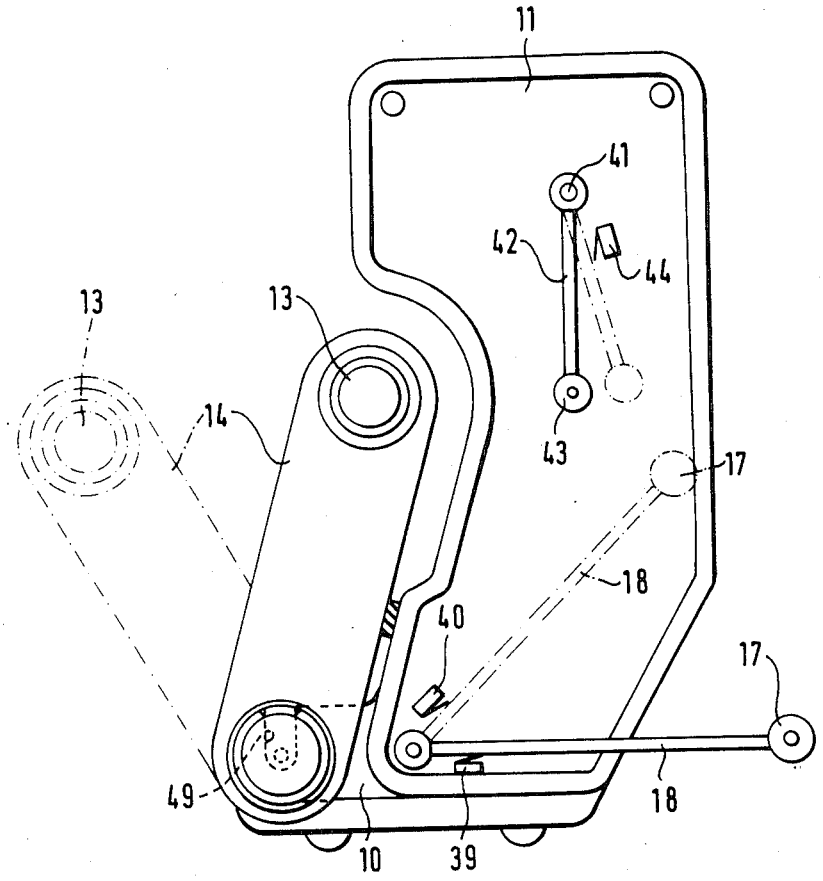

In detail the drawing shows:

FIG. 1 a schematic, overall front view of a winding-up device;

FIG. 2 a schematic cross-section through the winding-up device along the line II—II in FIG. 1, as an overall view;

FIG. 3 a front view of an embodiment of the winding-up device, partly in section;

FIG. 4 a cross-section through the device along the line IV—IV in FIG. 3.

The knitted fabric winding-up device shown in the drawing is constructed as an independent auxiliary device, which can be selectively installed in the front lower region of a flat knitting machine. It comprises a frame with a lower supporting cross member 10, which extends between two side housing elements 11 and 12 and, in addition, at whose ends there is mounted, in each case, an upwardly directed pivotable supporting arm 14 or 15 for a winding roller 13. In the embodiment shown, the supporting arms 14, 15 are securely connected to the supporting cross member 10, which terminates at each end in a bearing pin 48, which is locatable in a supporting bracket 49 formed in the side housing element 11 or 12, However, the supporting brackets 49 can also be formed directly on the frame of a flat knitting machine.

The lower supporting cross member 10 can be provided with rollers 16 to enable the whole device to be moved, which can be retracted in order to lower the frame down. There is also mounted on the lower supporting cross member 10, or on the side housing elements 11, 12 by means of two pivoted arms 18, a guide roller 17, over which a length of knitted fabric 20, shown in FIG. 2, drawn down from the stitch forming region 19 of a flat knitting machine schematically indicated by two needle beds 21 and 22, is led to a winding sleeve 23 pushed onto the winding roller 13 for the formation of a fabric package 24. The weight of the guide roller 17 causes a tension in the length of knitted fabric 20.

The drive motor 25 of the knitted fabric winding-up device is, as shown in FIG. 1, an electric motor and is so located inside the lower supporting cross member 10 that its drive shaft 26 is aligned with the pivot axis 27 (FIG. 3) for the two supporting arms 14 and 15. The rotational movement of the drive shaft 26 is transmitted from a drive pulley 28 to a shaft 30 mounted in the free end region of the supporting arm 14 by a toothed belt 29 located inside the supporting arm 14. The winding roller 13 is drivably connected with the shaft 30 by a coupling 31 shown only schematically in FIG. 1. Further, the other end of the winding roller 13 is mounted in the free end region of the other supporting arm 15 by means of a coupling 32 schematically indicated in FIG. 1, so that the winding roller 23 together with the package 24 formed on it can be uncoupled at both ends and removed from the frame of the winding-up device.

FIGS. 3 and 4 show further details of the construction of the winding-up device. The coupling 31 shown in FIG. 1 is intergrated in the supporting arm 14 in the mounting position for the shaft 30, which is also provided with a mechanical torque overload safety device 33. The coupling 32 shown schematically in FIG. 1 consists of a mounting pin 32.1, which is axially moveable by means of a coupling lever 34 mounted in the supporting arm 15, and which engages in an opening in the end face of the winding roller 13. The winding roller 13 can also be shifted axially by means of the coupling lever 34 so as to decouple the shaft 30. On the two supporting arms 14 and 15 are located, below the mounting positions and projecting above the supporting arms, dishes 35 and 36, which receive the ends of the winding roller 13 after decoupling at both sides at positions 47.1 and 47.2 introduced in FIG. 1, and in which the winding roller 13 can be turned by hand. The winding sleeve 23 pushed onto the winding roller 13 is provided on its outer surface with a retention coating, for example in the form of a Velcro tape 37, and is connected to the winding mandril 13 for rotation therewith by means of a locking pin 38.

The supporting arms 14, 15 with the winding roller 13 can be pivoted between an inner position, shown in full lines in FIGS. 2 and 4, and an outer position shown in chain-dotted lines. In both positions motor drive of the winding roller, when decoupled, can be effected. In the outer pivot position the fabric package 24 can be easily removed from the winding-up device.

The winding-up device is provided with an electrical control device for the drive motor 25. Included in this device are two limit switches 39 and 40, which limit the pivot range of the pivot arms 18 of the guide roller 17. When one of the pivot arms 18 operates the lower limit switch 39, the drive motor 25 is activated and winds-up the knitted fabric 20 (FIG. 2), which is led over the guide roller 17. As soon as a pivot arm 18 contacts the upper limit switch 40 due to an absence of supply of knitted fabric or to the winding-up speed exceeding the movement of the knitted fabric, the drive motor 25 is switched off again. Also incorporated in the control device, housed in the side housing element 11, are arms 42 pivoted on the side housing elements 11, 12 about an axis 41, and which carry a knitted fabric guide roller 43 at their free ends, serving as a sensing roller. The pivoted arms 42 can be brought to various base positions, which result in a varying spacing of the roller 43 from the winding roller 13. After reaching a package diameter determined by the base position, the package 24 (FIG. 2) presses against the roller 43 and due to pivotal movement of one of the arms 42 a limit switch 44 is operated and the drive motor 25 is halted. In addition, drive means can be provided to pivot the supporting arms 14 and 15 between the inner position and the outer position, which can also be controlled by the limit switch 44. Also, the drive motor for the winding roller 13 could be located on one of the supporting arms 14, 15. A second corresponding to the roller 43 could also be articulated on one of the supporting arms 14, 15 and could effect stoppage of the winding-up drive after a predetermined package diameter had been reached. When the winding-up roller is pivoted to the outer position, the knitting machine need not be halted and can supply further knitted fabric into the storage container.

There can be seen in FIG. 3 a further switch 45 located in the right hand side housing element 12, by which the direction of rotation of the drive motor 25 can be altered, and a pressure sensor 46 located in the left hand side housing element 11 for a short manual operation of the drive motor 25, and which are part of the control device of the winding-up device.

We claim:

1. A knitted fabric winding-up device for flat knitting machines, with a winding roller which is interchangeably mounted on a support beneath the flat knitting machine, extends in the longitudinal direction of the machine, is drivable by means of a motor and to which the knitted fabric is guided over a pivotable guide roller by whose weight the knitted fabric is tensioned and whose pivot range is limited in both directions by electrical switches of a control device which acts on the drive motor of the winding-up device, characterised in that the support, which is also provided with a drive motor (25), comprises a lower supporting cross member (10) at both of whose ends upwardly directed supporting arms (14, 15) are located and are pivotable over a limited arc about an axis extending in the longitudinal direction of the supporting cross member (10), and at whose free upper ends the mounting positions and the coupling positions (31, 32) for the ends of interchangeable winding roller (13) are constructed, the arrangement being such that the winding roller (13) is pivotable from an inner position to an outer position located at the front side of the flat knitting machine and is also pivotable in the reverse direction.

2. A winding-up device according to claim 1, characterised in that the drive device is so located and constructed that it is operable independently of the pivot position of the supporting arms (14, 15).

3. A winding-up device according to claim 2, characterised in that the drive motor (25) for the winding roller (13) is located in one of the pivoted arms.

4. A winding-up device according to claim 2, characterised in that the drive motor (25) for the winding roller (13) is located in the lower cross member (10) and the drive connection has a drive wheel (28) arranged co-axially or concentrically with the pivot axis (27) of the supporting arms for co-operation with a drive belt located in one of the supporting arms (14).

5. A winding-up device according to claim 1, characterised in that the winding roller (13) can be released at one end from its drivable mounting and coupling position (31) by axial movement.

6. A winding-up device according to claim 5, characterised in that the winding roller (13) is mounted at its other end on the mounting position of a supporting arm (15) by means of coupling pin (32.1), which is longitudinally moveable for decoupling the winding roller.

7. A winding-up device according to claim 5, characterised in that there is located on both pivotable supporting arms (14, 15) in front of and below the mounting positions and extending above the supporting arms (14, 15), dish members (35, 36) for reception of the ends of the decoupled winding roller (13) so that the winding roller can be freely rotated by hand.

8. A winding-up device according to claim 1, characterised in that it is constructed as an auxiliary device with a moveable support selectively locatable in a flat knitting machine.

9. A winding-up device according to claim 1, characterised in that it is constructed as an auxiliary device in such a way that the supporting cross member (10) is pivotable together with the supporting arms (14, 15) on mounting pins (48), which can be inserted in mounting positions (49) on the frame of the knitting machine.

10. A winding-up device according to claim 1, characterised in that the winding roller (13) is so constructed that a winding-up sleeve (23), provided on its outer surface with a retention coating (37), which can be connected to the winding roller for rotation therewith, can also be pushed off the roller.

11. A winding-up device according to claim 1, characterised in that the associated control device has a pivoted arm (42), which ends in a sensing roller (43) lying against the package (24), and which co-operates with a stop switch (44) and can be moved to various base positions.

12. A winding-up device according to claim 11, characterised in that the pivoted arm (42) is mounted on one of the two pivotable supporting arms (14, 15).

13. A winding-up device according to claim 1, characterised in that it has separate drive devices for synchronous pivoting of the two supporting arms (14, 15).

* * * * *